United States Patent [19]

Weber

[11] Patent Number: 4,492,324

[45] Date of Patent: Jan. 8, 1985

[54] CONTAINER WITH INTEGRAL FLEXIBLE NECK

[76] Inventor: Heinz Weber, 14 Lakeview Blvd., Beaconsfield, Quebec, Canada

[21] Appl. No.: 358,048

[22] Filed: Mar. 15, 1982

[51] Int. Cl.[3] ..... B67D 5/37

[52] U.S. Cl. ..... 222/529; 222/530

[58] Field of Search ..... 222/527, 529, 215, 107, 222/206, 526, 530, 538, 566

[56] References Cited

U.S. PATENT DOCUMENTS

| | | | |
|---|---|---|---|
| 1,418,576 | 6/1922 | Johnston . | |
| 1,733,079 | 5/1928 | Graves et al. . | |
| 2,757,829 | 3/1953 | Ahlquist . | |
| 2,791,357 | 12/1954 | Nelson . | |
| 3,099,373 | 3/1961 | Gandrud . | |
| 3,155,281 | 11/1964 | Stracey | 222/529 X |
| 3,298,577 | 1/1967 | Chlystun | 222/530 X |
| 3,476,111 | 11/1969 | Matheson . | |
| 4,068,778 | 1/1978 | Wilson | 222/566 X |
| 4,082,827 | 4/1978 | Chlystun . | |
| 4,095,728 | 6/1978 | Chlystun | 222/529 |
| 4,236,655 | 12/1980 | Humphries . | |
| 4,243,162 | 1/1981 | Klygis | 222/530 |
| 4,351,454 | 9/1982 | Maynard | 222/143 |

FOREIGN PATENT DOCUMENTS

| | | |
|---|---|---|
| 185533 | 7/1918 | Canada . |
| 467044 | 8/1950 | Canada . |

OTHER PUBLICATIONS

*Packaging Engineering*–Ad for container with Flexible Nozzle.

*Primary Examiner*—Stanley H. Tollberg
*Assistant Examiner*—Laurence J. Miller
*Attorney, Agent, or Firm*—Larson & Taylor

[57] ABSTRACT

A container is disclosed which is suitable for liquids having a flexible neck integral with the container which can be flexed to a flexed position and retained in that position. This allows the container to be used for filling inaccessible filler holes on motor vehicles and the like. The flexible neck portion has a smaller cross sectional area than the container. The neck comprises a plurality of specially shaped accordion ribs extending for at least a part of the length of the neck portion such that an integral pouring spout at the end of the neck portion can be flexed to a flexed position from an upright position to accommodate pouring, and generally retain the flexed position. The spout has a cap supporting portion thereon.

12 Claims, 15 Drawing Figures

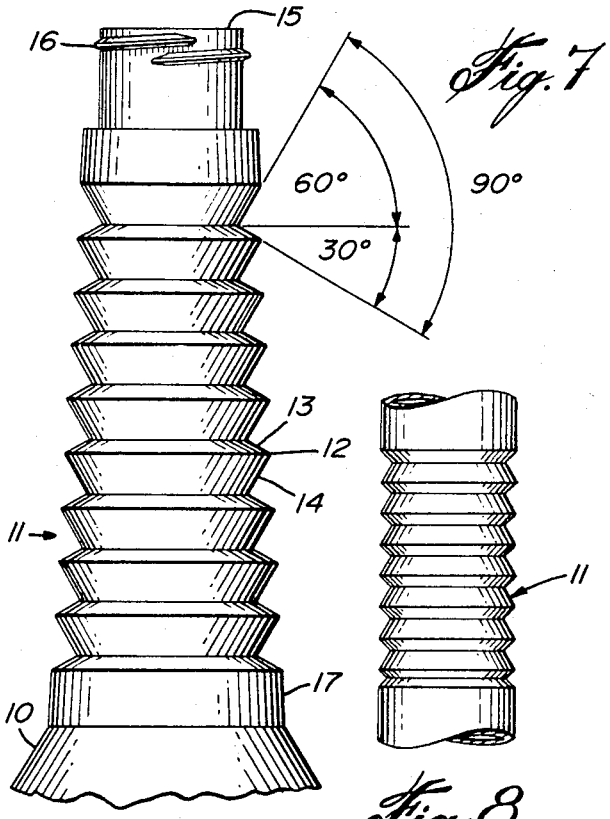
Fig. 7
Fig. 8
Fig. 9
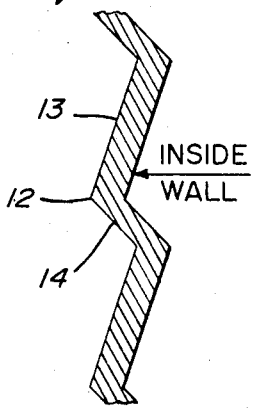
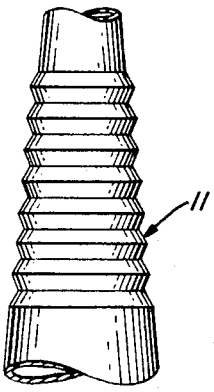
Fig. 10
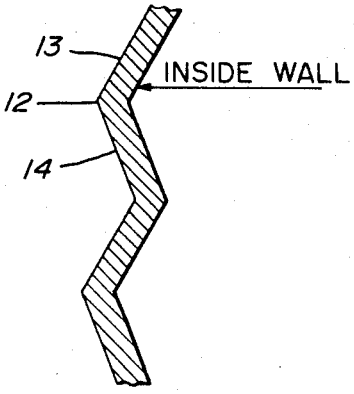
Fig. 11

CONTAINER WITH INTEGRAL FLEXIBLE NECK

BACKGROUND OF THE INVENTION

This invention relates to a container having integral therewith a flexible neck. More particularly, a flexible neck integral with a container is disclosed such that a spout at the end of the neck can be flexed from an upright position and generally retain the flexed position.

Liquids, particularly those liquids supplied by oil companies for automobiles, lawnmowers, outboard motors, and other equipment utilizing internal combustion engines, are generally supplied in disposable plastic containers. The type of liquids include engine oil, transmission fluids, brake fluids, engine additives, antifreeze, windshield washer fluids and many others, and they generally have to be poured into filler holes or accesses which are often difficult to reach with a large container and require a separate funnel or spout to avoid spilling the liquids. In attempts to overcome this, the shapes of containers have been made more convenient, and in some cases a long neck has been added to the container, however, these solutions do not solve all of the problems. Other alternatives are to add a special spout onto a container by means of a snap or screw fastening. However, a separate spout is inconvenient because it is often misplaced or lost, particularly when the container is used more than once for topping up liquid levels.

SUMMARY OF THE INVENTION

The present invention overcomes many of the problems that occur with existing containers in that it supplies a container having integral therewith a flexible neck with a spout on the end, such that the neck can be flexed from an upright position. The angle of flex can be designed for the requirements of the containers. Flex angles up to 90° or more from the upright position can be provided. By having the neck integral with the container, there is no need to use a separate funnel or spout, the spout may be flexed in any direction to suit a filling access in a motor vehicle or like product, and when the container is empty, the complete unit is thrown away. Thus, there is no chance of misplacing a separate spout as it is integral with the container. Whereas we have discussed this container unit as being suitable for the oil companies, it will be apparent that such a container having an integral flexible neck could be used in many other applications wherein a liquid is to be poured into inaccessible locations.

The present invention provides a container having integral therewith a flexible neck portion with a smaller cross sectional area than the container, the neck portion comprising a plurality of specially shaped accordion ribs around the neck portion extending for at least a part of the length of the neck portion, such that an integral pouring spout at the end of the neck portion can be flexed to a flexed position from an upright position to accommodate pouring and generally retain the flexed position, the spout having cap supporting means thereon.

In other embodiments, the neck portion may have parallel or spiral ribs. In another embodiment there are provided multiple ribs to allow a flexed position of up to 90° or more from the upright position. Various materials may be used for the container including rigid or flexible polyvinyl chloride resins with or without additives, polyesters, copolyesters, polypropylene, polycarbonates, acrylics such as ABS and nitriles and other suitable resins or mixtures thereof that can be molded. In another embodiment the container may be molded in high density or low density polyethylene. There may be a screw cap or a snap-on cap, and in yet a further embodiment the neck portion is retractable and an overcap is provided to hole the neck portion in the retracted position.

The neck portion may have straight, tapered, concave or convex sides, the cross sectional shape of the neck portion may be round, polygonal, oval or any other required shape. The space between each parallel rib in one embodiment is equal, and in another embodiment is unequal. In a further embodiment, a circular rib profile is provided having an upward and inward sloping wall from an extremity of each rib, having an angle of about 60° to the horizontal, a downward and inward sloping wall from the extremity of each rib having an angle of about 30° to the horizontal, and wherein the vertical height of the downward sloping wall is about one-third of the vertical height of the upward sloping wall. In another embodiment the angles of the upward sloping walls and downward sloping walls are reversed. In another embodiment angles of the upward and downward sloping walls are substantially the same, or these sloping walls may be curved. In yet a further embodiment the neck portion may have at least one section along the length of the neck portion which has no ribs thereon.

BRIEF DESCRIPTION OF THE DRAWINGS

In drawings which illustrate the embodiments of the invention,

FIG. 7 is detailed elevational view of one embodiment of a neck portion of a container.

FIGS. 8–15 show detailed views of other embodiments of rib configurations for the neck portion of containers.

DETAILED DESCRIPTION OF THE PREFERRED EMBODIMENT

Figure 1:
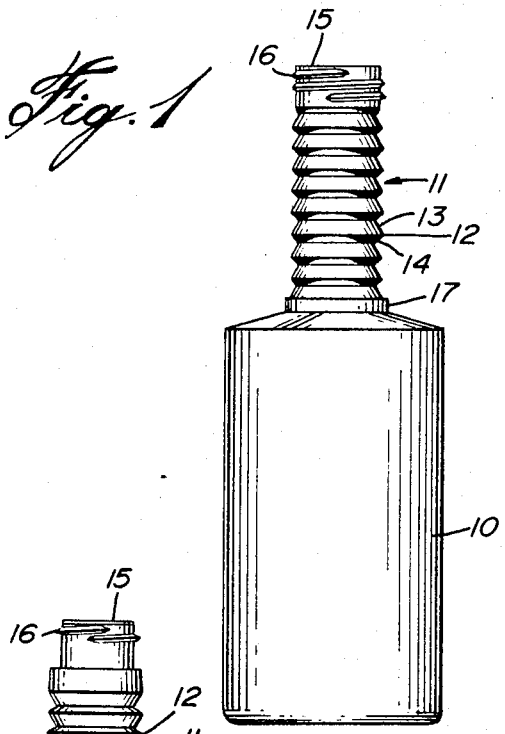
FIG. 1 is a side elevational view of one embodiment of a container having a flexible neck portion integral therewith.

Containers of the type illustrated in the drawings are generally formed of a plastic material. They may be molded from resins with or without additives by a number of known techniques, the material may be high density or low density polyethylenes, polypropylenes, rigid or flexible polyvinyl chlorides, polyesters or copolyesters, polycarbonates, acrylics such as ABS or nitrile resins or any suitable resins or mixtures thereof that can be molded. Containers may be made of different materials to suit different requirements.

Suitable processes for producing containers include conventional extrusion, blow molding or injection blow molding. Another process that is particularly applicable is transfer molding wherein a preform is first made and in a second step the preform is heated and molded into the desired shape. This type of molding is applicable to polyesters and copolyesters. It allows the preform to be made in one location and then shipped to another location where the second step occurs. The premold is far smaller than the finished product, and thus the required shipping space is less than for a finished product.

Figure 2:
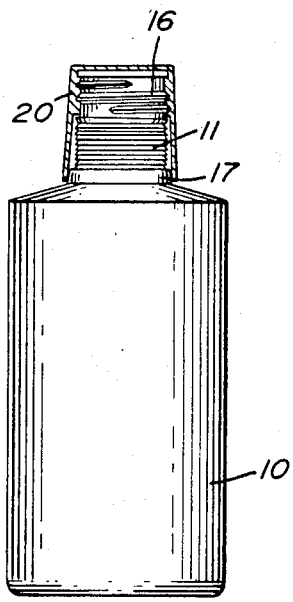
FIG. 2 is a side elevational view of the container shown in FIG. 1 with the neck portion retracted and an overcap holding the neck portion in the retracted position.

FIG. 1 shows a container 10 which as illustrated is a cylindrical container, but may be any shape. The shape of the container does not constitute part of the present invention. The neck portion 11 has a smaller diameter and cross sectional area than the container and is integrally joined to the top of the container 10 and comprises a plurality of specially shaped accordion style circular ribs 12 with an upward and inward sloping wall 13 from the extremity of each rib, having a greater angle than a downward and inward sloping wall 14 from the extremity of each rib 12. Eight circular ribs 12 are shown in the figure and the number of the ribs 12 and the configuration of the ribs 12 is such that a spout 15 at the end of the neck portion 11 can be flexed to a flexed position of 90° or more from the upright position. This flexed position accommodates pouring and the neck portion 11 generally retains the shape of the flexed position although some spring back, sometimes as much as 5% of the angle of bending, can occur dependent upon the shape of the ribs, thickness and type of material. The neck portion 11 can be pushed back to the upright position and can be flexed in any direction from this upright position and will remain in that flexed position. The spout 15 at the top of the neck portion 11 has a screw thread 16 for a screw cap (not shown) to be fitted. Where the neck portion 11 is integrally joined to the container 10, a flange 17 is provided and as shown in FIG. 2 the flange 17 is used to support an overcap 20 which has a screw thread at the top to fit over the screw thread at the spout 15, and allows the neck portion 11 to be completely retracted. The edge of the overcap 20 grips the flange 17 on the container 10 to hold the neck portion 11 in the retracted position. In one embodiment screw threads may be provided on the flange 17 and the lip of the overcap 20 to hold the overcap 20 in position.

Figure 3:
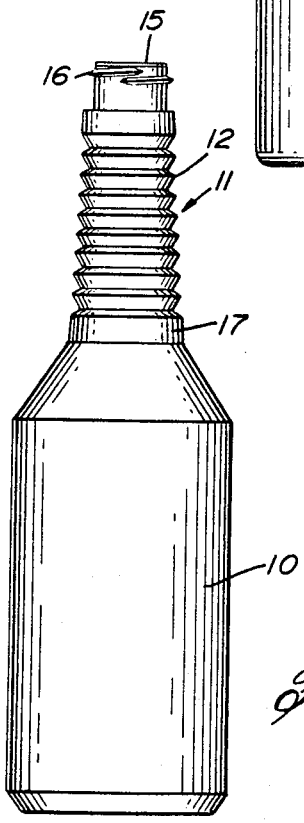
FIG. 3 is a side elevational view of another embodiment of a container having a flexible neck portion integral therewith.
Figure 4:
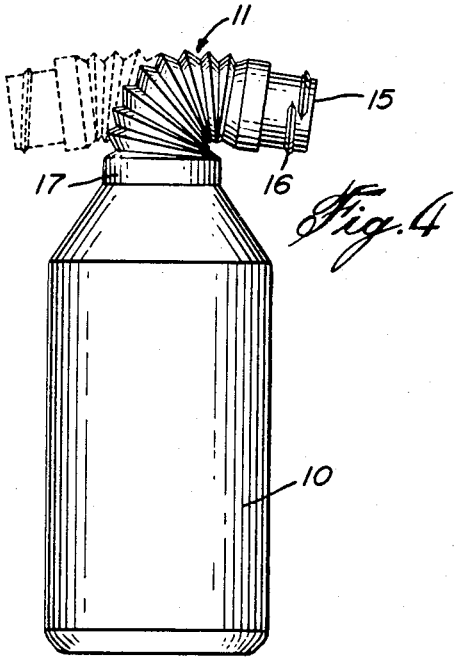
FIG. 4 is a side elevational view of the container shown in FIG. 3 with the spout at the end of the neck portion bent at an angle greater than 90° from the upright position.
Figure 5:
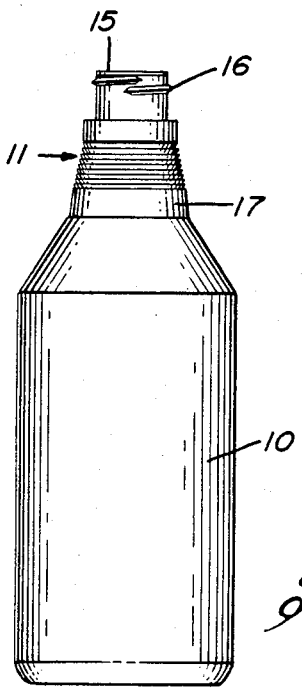
FIG. 5 is a side elevational view of the container shown in FIG. 3 with the neck portion retracted.

Whereas FIG. 1 shows a neck portion 11 which has substantially straight sides, FIG. 3 illustrates a neck portion 11 which has tapered sides so that the top ribs 12 of the neck portion have a smaller diameter than the bottom ribs. A total of eight ribs 12 are shown in the neck portion 11. FIG. 4 illustrates the neck portion 11 bent or flexed, so that the spout 15 is at an angle of over 90° from the upright position, shown in FIG. 3. The neck portion 11 generally retains this position until it is moved to the upright or another flexed position. FIG. 5 illustrates the container shown in FIG. 3 with the neck portion 11 retracted. An overcap is not shown, however, the overcap could be integral with the spout cap to fit over the screw thread 16 on the spout 15 or, alternatively, could be a separate overcap which covers the spout cap and grips the flange 17 on the container.

Figure 6:
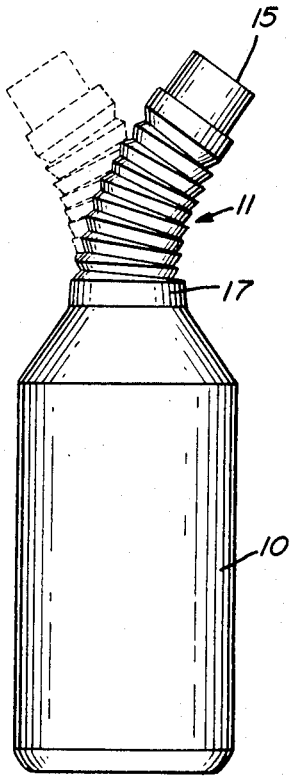
FIG. 6 is a side elevational view of another embodiment of a container having a flexible neck portion integral therewith.

Another embodiment of a container is illustrated in FIG 6 wherein the spout 15 is adapted to take a snap-on cap (not shown). The neck portion 11 is shown flexed at an angle of about 30° from the vertical position. The neck portion 11 is flexed in any direction, and can in some circumstances be flexed so that the spout 15 is parallel to the axis of the container, but is displaced by two bends in the neck portion. This allows access to hard to reach filling apertures.

Details of the neck portion 11 are shown in the remaining drawings. FIG. 7 shows a neck portion 11 with tapered sides having an angle of about 3° to the vertical. The ribs 12 have an upward and inward sloping wall 13 from the extremity of the rib at an angle of about 30° to the horizontal, and a downward and inward sloping wall 14 from the extremity of the rib at an angle of about 60° to the horizontal. In this arrangement the vertical height of the upper sloping wall 13 is about one-third of the vertical height of the downward sloping wall 14.

Figure 12:
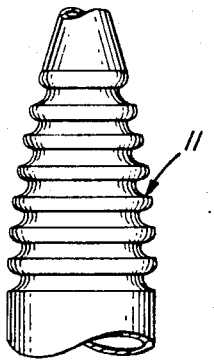
Figure 13:
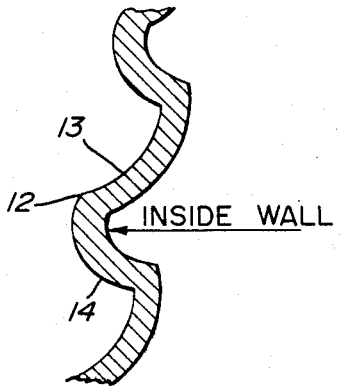
Figure 14:
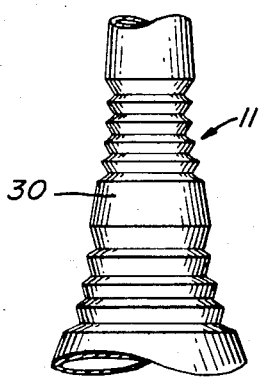
Figure 15:
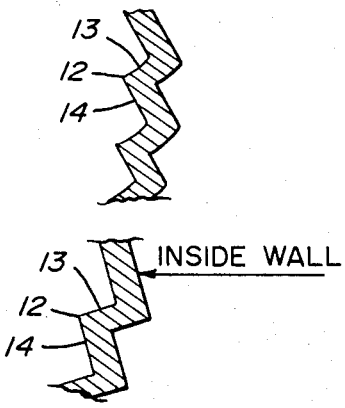

A straight-sided neck portion 11 is shown in FIG. 8, with a cross sectional detail of the neck portion shown in FIG. 9. As illustrated, the upward and inward sloping wall 13 from the extremity of the rib is at a steeper angle to the horizontal than the downward and inward sloping wall 14 from the extremity of the rib. FIGS. 10 and 11 illustrate a tapered neck portion 11 with the upward sloping wall 13 and the downward sloping wall 14 having approximately the same angle and being approximately the same vertical distance. FIGS. 12 and 13 show a convex shaped neck portion 11, with a curved upward sloping wall 13 and a curved downward sloping wall 14. FIGS. 14 and 15 show a concave shaped neck portion 11 having a straight section 30 at the approximate center of the neck portion 11, where there are no ribs present.

Whereas the drawings illustrate circular ribs, it will be understood that spiral ribs may equally well be used. Spiral ribs may be a single start or multi-start spiral. The horizontal cross section of the neck portion is illustrated in the drawings as being round, however, the cross section may be polygonal, oval, or whatever shape is desired. A round cross section for the neck portion permits the neck portion to be flexed in any direction, whereas a triangular or square neck portion may provide some limitations. This, of course, is easily overcome by merely rotating the container itself. The cross section of the neck portion may be square with sharp angles, or radiused corners, or rectangular with sharp angles or radiused corners, or trapezoidal in shape. In all cases the ribs are specially shaped accordion style so that when the neck portion is flexed it stays in the flexed position or very close to the flexed position.

Various changes may be made to the embodiments shown without departing from the scope of the present invention, which is limited only by the following claims.

The embodiments of the invention in which an exclusive property or privilege is claimed, are defined as follows:

1. A container having integral therewith a flexible neck portion with a smaller cross sectional area than the container, the neck portion comprising a plurality of specially shaped accordion ribs around the neck portion extending for at least a part of the length of the neck portion said ribs having a circular profile shaped such that when the neck portion is fully extended each of the ribs has a curved upward and inward sloping wall from an extremity of each of the ribs and a curved downward and inward sloping wall from the extremity of each of the ribs, such that an integral pouring spout at the end of the neck portion can be flexed to a flexed position from an upright position to accommodate pouring, and generally retain the flexed position, the neck portion being retractable such that the walls of the accordion ribs are substantially flat, the spout having a cap to hold the neck portion in a retracted position supported on the container.

2. The container according to claim 1 wherein the accordion shaped ribs around the neck portion are parallel.

3. The container according to claim 2 wherein the cross sectional shape of the neck is round and the ribs are equi-spaced apart.

4. The container according to claim 2 wherein the cross sectional shape of the neck is round and unequal spaces occur between the ribs.

5. The container according to any of claims 1 or 2 having eight specially shaped accordion ribs.

6. The container according to any of claims 1 or 2 wherein the neck portion can be flexed such that the spout is at an angle of up to 90° or more from the upright position.

7. The container according to any of claims 1 or 2 formed from material selected from the group consisting of, rigid or flexible polyvinyl chloride resins with or without additives, polyesters, copolyesters, polypropylene, polycarbonates, acrylics such as ABS or nitrile resins.

8. The container according to any of claims 1 or 2 molded in high density or low density polyethylene.

9. The container according to any of claims 1 or 2 wherein the cap is a screw-on cap, attached to a threaded shoulder on the container.

10. The container according to any of claims 1 or 2 wherein the cap is a snap-on cap attached to a shoulder on the container.

11. The container according to any of claims 1, 2 or 3 wherein the neck portion has substantially convex sides.

12. The container according to claims 1, 2 or 3 wherein the cross sectional shape of the neck portion is round and the neck portion can be flexed in any direction away from the upright position.

* * * * *